United States Patent [19]

Katayama

[11] 3,975,803

[45] Aug. 24, 1976

[54] FASTENING SNAP

[75] Inventor: Morio Katayama, Tokyo, Japan

[73] Assignee: Gondra Industries & Co., Japan

[22] Filed: May 16, 1975

[21] Appl. No.: 578,360

[30] Foreign Application Priority Data

May 21, 1974 Japan ..... 49-57061

[52] U.S. Cl. ..... 24/217 R

[51] Int. Cl.[2] ..... A44B 17/00

[58] Field of Search ..... 24/217 W, 219, 208 R, 24/220, 213 R, 214, 216, 217

[56] References Cited

UNITED STATES PATENTS

| | | | |
|---|---|---|---|
| 1,965,115 | 7/1934 | Fenton | 24/217 |
| 2,042,866 | 6/1936 | Simons | 24/208 R |
| 2,071,505 | 2/1937 | Dews | 24/219 |
| 2,134,037 | 10/1938 | Fenton | 24/219 |
| 2,468,630 | 4/1949 | Huelster | 24/220 |
| 3,196,512 | 7/1965 | Koehl | 24/219 X |

FOREIGN PATENTS OR APPLICATIONS

| | | | |
|---|---|---|---|
| 257,102 | 3/1949 | Switzerland | 24/217 |

*Primary Examiner*—Donald A. Griffin
*Attorney, Agent, or Firm*—McGlew and Tuttle

[57] ABSTRACT

A small size snap fastener comprises male and female members formed of thin sheet metal, and each including a metal fitting and a washer. In each case, the metal fitting engages one surface of sheet material and the washer engages the opposite surface thereof, with the metal fitting and the washer firmly gripping the sheet material to an extent sufficient to prevent slipping caused by tearing or rupture of the sheet material at the location where the member is secured to the sheet material. The male metal fitting includes a head having releasable snap engagement in a recess in the associated female metal fitting. The male washer has a central fitting extending therefrom and penetrating through the sheet material to engage in the interior of the head of the male metal fitting and be flared outwardly therein for anchoring. The female metal washer also has a central tube projecting therefrom and engaging through a central opening in the portion of the female metal fitting arranged to receive the head of the male fitting, this tube being then flared outwardly for anchoring purposes. In one embodiment of the invention, the male metal washer is formed with a reentrant periphery and the male metal fitting is formed with pawls adjacent its periphery which penetrate through the sheet material and extend into the reentrant periphery of the male metal washer where the pawls are bent reversely on themselves for anchoring of the male metal washer to the male metal fitting at their peripheries. In this embodiment, the female metal fitting has pawls adjacent its periphery which penetrate through the sheet material and extend into the reentrant periphery of the female metal washer where the pawls are bent reversely on themselves for anchoring. In a second embodiment of the invention, the male and female metal members are formed with the reentrant periphery and the pawls are formed adjacent the periphery of the respective metal washer.

5 Claims, 14 Drawing Figures

FASTENING SNAP

FIELD AND BACKGROUND OF THE INVENTION

This invention relates to a fastening snap for the use in fastening clothing a pouch, and a sheet of plastic and the like.

A conventional fastening snap usually comprises a male member and a female member, the male member comprising a male metal fitting and a male washer, and the female member comprising a female metal fitting and a female washer, the male metal fitting, penetrating through a sheet of fabric, leather, plastic and the like, engages tightly with the male plate washer to form the male member in a caulked condition such that no space may be left therebetween. The female metal fitting, penetrating through a sheet, engages the female washer to form the female member in a caulked condition such that no space may be left therebetween. The male member has a projecting member and the female member has a hollow area into which the projecting member of the male member is detachably inserted to form a fastening snap.

SUMMARY OF THE INVENTION

This invention also comprises a fastening snap such as mentioned above, but is directed to an improvement on a specific structure in which a male metal fitting is fastened tightly with a male washer or a female metal fitting is fastened tightly with a female washer in a caulked condition such that no space is left therebetween when penetrating through a sheet such as mentioned above.

The present invention has for its object to provide a fastening snap whose male member is solidly fastened to a female member penetrating through a sheet and, in addition, even though a fastening snap according to the present invention is of very tiny size and of a thin sheet metal it has power for holding solidly a sheet such that it is free from slipping caused by a tearing or rupture of the spot where the snap is fastened on.

For an understanding of the present invention, reference is made to the following description of typical embodiments thereof as illustrated in the accompanying drawings.

DESCRIPTION OF THE PREFERRED EMBODIMENTS

Figure 1:
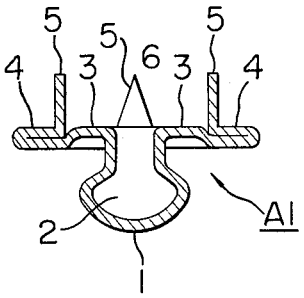
FIG. 1 is a diametric sectional view of a male metal fitting according to a first embodiment of the invention.
Figure 2:
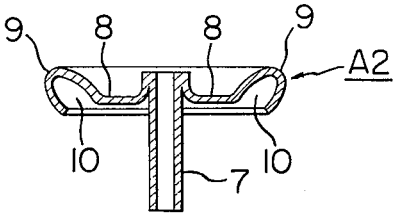
FIG. 2 is a diametric sectional view of the male metal washer of the first embodiment.

FIG. 1 to FIG. 7 show a first embodiment of the present invention, among which FIG. 1 shows a male metal fitting A1 of a male member A and FIG. 2 shows a male washer A2 of male member A. The male metal fitting A1 has a projecting member 1 provided with a hollow 2 in its center, and male metal fitting A1 is formed with a curved periphery (4) provided by bending a lateral edge 3 extending from projecting member 1, curved lateral edge 3 being formed with pawls 5 extending perpendicularly outwardly therefrom. The numeral 6 denotes an opening into hollow 2 of the projecting member 1.

Male washer A2 has a short tube 7 projecting therefrom, which is adapted to be inserted into hollow 2 of the projecting member 1 by penetrating througj a sheet S from the back side of projecting member 1 and passing through opening 6. The horizontal portion 8 extending from short tube 7 is bent to form a flexible edge 9 on the projecting side of short tube 7, thereby providing an opening 10 thereof into which pawls 5 may be introduced.

Figure 5:
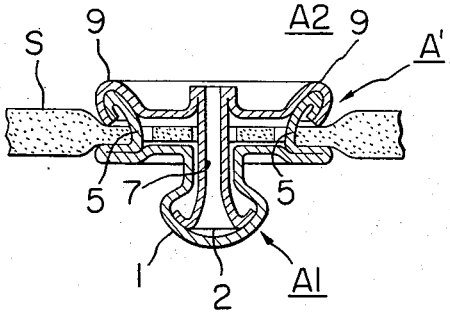
FIG. 5 is a diametric sectional view of the male metal fitting and the male metal washer, of the first embodiment, as engaged with a sheet of material and firmly gripping the sheet therebetween.

In gripping a sheet S of fabric, leather, plastic and the like between the back side of male metal fitting A1 and the short tube 7 side of said male washer A2 made as mentioned above the fastening snap compresses the sheet S. As shown in FIG. 5, pawls 5 of the male metal fitting A1 penetrating the sheet S and entering the opening 10 of flexible edge 9 of the male washer A2 flex along the back surface of edge 9 and the short tube 7 of the male washer A2, which penetrates through the sheet S, is held tightly in the hollow 2 of projection 1 whereby, as shown in FIG. 5, the male metal fitting A1 is fixed tightly onto the male washer to form the male member A of a fastening snap according to the present invention.

Figure 3:
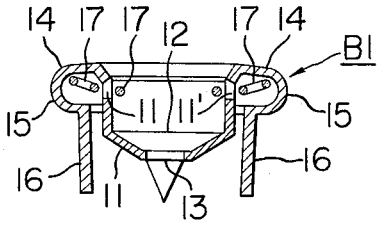
FIG. 3 is a diametric sectional view of a female metal fitting of the first embodiment.
Figure 4:
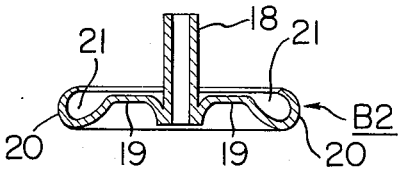
FIG. 4 is a diametric sectional view of the female metal washer of the first embodiment.

FIG. 3 shows a female metal fitting B1 of a female member B and FIG. 4 shows a female washer B2 of the female member B, of a fastening snap according to the present invention.

The female metal fitting B1 has a setting portion 12, for the insertion of the projecting member 1 of the male member A, which is formed by an indented wall 11 extending into the interior of the center of female metal fitting B1. This indented wall 11 has a central hole 13. The outwardly extending top edge portion 14 adjacent to the base of indented wall 11 is bent into a U-shaped flexible edge 15 and then bent to form pawl 16.

In addition, a spring 17 is inserted in the interior surrounded by the U-shaped flexuous edge 15 so that spring 17 extends through holes 11' 11' formed in indented wall 11.

The female washer B2 has the same structure as that of the male washer A1, and the reference numeral 18 denotes a short tube, 19 a horizontal edge, 20 a flexible edge, and 21 an opening encircled by the flexible edge. In gripping a sheet S of fabric, leather, plastic and the like between the back side of female metal fitting B1 and the short tube side 18 of female washer B2 constructed as mentioned above, the female fastening member compresses the sheet S.

Figure 6:
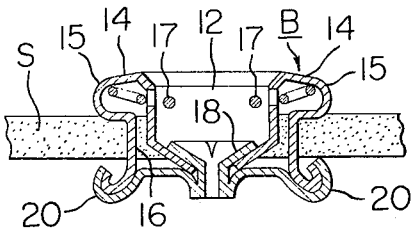
FIG. 6 is a view, similar to FIG. 5, illustrating the female metal fitting and the female metal washer as engaging a sheet of material and gripping the same therebetween.
Figure 7:
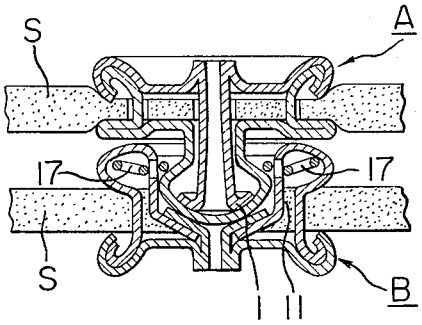
FIG. 7 is a diametric sectional view illustrating the male and female members of the first embodiment as interengaged.

As shown in FIG. 6, pawls 16 of female metal fitting B1, penetrating through the sheet S and entering the opening 21 of flexible edge 20 of the female plate washer B2 flex along the back surface of edge 20, and the short tube 18 of female washer B2 is inserted into hole 13 which is provided at the bottom of indented wall 11 of female metal fitting B1, short tube 18 being then flared to be fastened tightly in the interior of the setting portion 12 and, as shown in FIG. 6, female metal fitting B1 is secured to washer B2 to form a female member B of the fastening snap. When the projecting member 1 of the male member A is set into the projecting member setting portion 12 of the female member B, as shown in FIG. 7, the base of the projecting member 1 is resiliently held by spring 17 to be detachably compressed.

Figure 8:
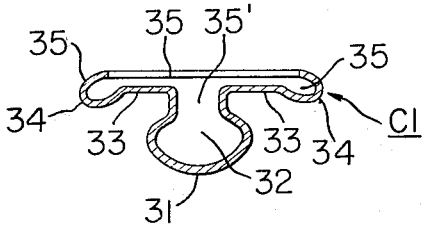
FIG. 8 is a diametric sectional view of the male metal fitting of a second embodiment of the invention.
Figure 9:
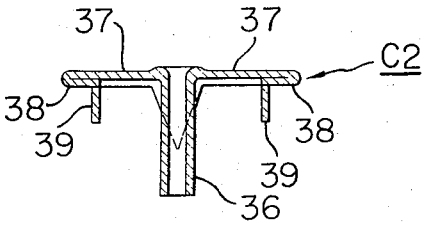
FIG. 9 is a diametric sectional view of the male metal washer of the second embodiment.

FIG. 8 to FIG. 13 show a second embodiment of the invention. FIG. 8 shows a view of a male metal fitting C1 of a male member C, and FIG. 9 shows a male member washer C2 of male member C.

Male metal fitting C1 has a projecting member 31 having a hollow 32 in its center, and a portion 33, which extends outwardly from projecting member 31, is flexed into a U-shaped flexible edge 34 toward the back side, thereby providing an opening or recess 35 which communicates with hollow 32 of projecting member 31. Reference numeral 35'' indicates an opening of hollow 32 of projecting member 31.

Figure 12:
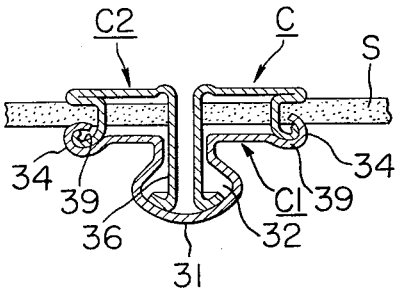
FIG. 12 is a diametric sectional view of the male metal fitting and the male metal washer as interconnected through a sheet of material and gripping the sheet therebetween.

The male washer C2 has a protruding short tube 36 which is adapted to be introduced into the interior of the hollow 32 from the back side of the projecting member 31, and a horizontal peripheral portion 37, which is connected with short tube 36, is bent toward the back side to form a flexible edge 38 from which pawls 39 extend integrally. As shown in FIG. 12, in gripping a sheet S of fabric, leather, plastic and the like between the back side of male metal fitting C1 and the protruding side of tube 36 of male washer C2, the male snap member compress the sheet S.

As shown in FIG. 12, pawls 39 of male washer C2, penetrating through sheet S and entering the opening 35 of flexible edge 34 of the male metal fitting C1 flex along the inside of the edge 34 and the short tube 36 penetrates through the sheet S to enter the hollow 32 through the opening 35' of the projecting member 31 from the back side of the projecting member 31 and is flared outwardly therein, whereby the male metal fitting C1 and the male washer are fixed with each other through the sheet S to form the male member C of the fastening snap.

Figure 10:
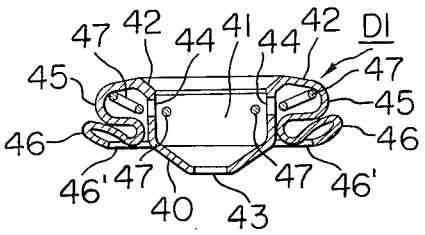
FIG. 10 is a diametric sectional view of the female metal fitting of the second embodiment.
Figure 11:
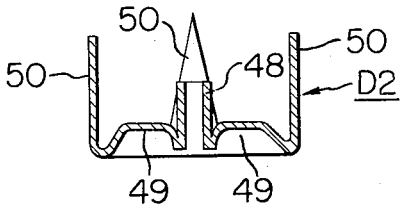
FIG. 11 is a diametric sectional view of the female metal washer of the second embodiment.

FIG. 10 shows a view of a female metal fitting D1 of a female member D and FIG. 11 shows a view of a female washer D2 of female member D. The female metal fitting D1 has a recess 41 for engaging therein of the projecting member 31 of male member C, this recess being constituted by an indented wall (40) sliping into the interior of the center of the female metal fitting D1. Wall 40 has an opening 43 in the bottom and holes 44 around the side thereof. An edge 42 of indented wall 40 expands outwardly therefrom and is flexed into a U-shaped flexible portion 45 on the protruding side of indented wall 40, and further the tip edge of flexible portion 45 is again flexed outwardly into a U-shape to form a flexible edge 46. Reference numeral 46' denotes an opening of portion 45. A spring 47 is provided in the U-shaped flexible portion 45 so that a portion of the spring 47 extends through holes 44 toward the side of the indented wall 40 where the projecting member 31 may be engaged therein. The female washer D2 has in its center a protruding short tube 48, and has protruding pawls 50 integrally arranged thereto and extending up from the periphery of the edge 49 extending from short tube 48.

Figure 13:
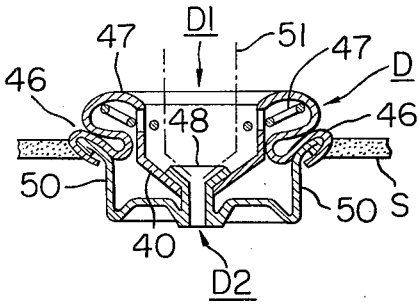
FIG. 13 is a diametric sectional view of the female metal fitting and the female metal washer of the second embodiment as engaged through a sheet of material and gripping the same therebetween.

When a sheet S, which is gripped between the back side of female metal fitting D1 and the back side of female washer D2 as shown in FIG. 13, is compressed by female metal fitting D1 and female washer D2 which are shown in FIG. 10 and FIG. 11, the pawls 50 of female washer D2, penetrating through sheet S, enter opening 46' of portion 46 of female metal fitting D1 and thus are secured to portion 46. At the same time, the short tube 48 of female washer D2, entering the hole 43 of the bottom of the indented wall 40, of the female metal fitting (D1) is flared by a punch 51 so that the female metal fitting (D1) is fixed to female washer (D2) keeping the sheet (S) therebetween.

As set forth above, a fastening snap according to this invention is so devised that a metal fitting and a washer which are facing to each other, that is, a male metal fitting and a male washer, and a female metal fitting and a female plate washer, are adapted to be fixed by a short tube at the center, and fastened by pawls at the peripheral edges thereof. Conventionally, as a means for forming a male member and a female member of a fastening snap of this kind, there has either been provided a short tube which, being placed at the center of a washer and penetrating through a sheet, is inserted into an indented portion where an engaging projecting member of a male metal fitting or an engaging projecting member of a female metal fitting is to be engaged therewith, or there has been provided pawls projecting at some spots in the peripheral edge of the washer, the fitting pawls being passed through a sheet and introduced into the interior of a wound and bent edge provided at the periphery of a male metal fitting, or a female metal fitting and then secured therein bending.

However, in the former, because the sheet will have a small circular hole formed therein by the short tube, it becomes loose at the center portion where the male member or female member is fixed on, and further, because the male member and the female member are fastened tightly only at the center thereof, the holding force will be exerted on only the center thereof, and the circumferences of the male member and the female member are apt to become disjoined.

In the latter, because the pawls on the periphery of the washer are introduced into the interior of the wound and bent edge provided the periphery of the male metal fitting or the female metal fitting and reversely bent or deflected the male metal fitting and the metal washer, or the female metal fitting and the female washer, are joined at the peripheral edge. Such fixing is supported merely by the flexing of the pawls, so that the pawls have to be bent or deflected and curved within the interior of the wound and curved edge of a male metal fitting or a female metal fitting without having loose and shaky engagement therein. For that very reason, the pawls need to have a sufficient thickness and further because pawls should usually be made integral with a washer, it has increased the thickness of a washer. However, if a washer is manufactured too thick, it makes the manufacturing of a fastening snap with a small diameter difficult.

Figure 14:
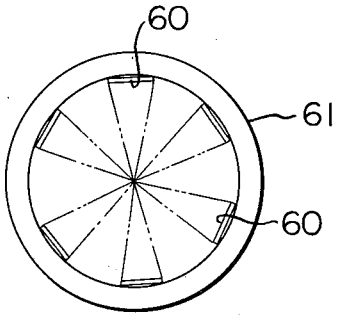
FIG. 14 is a plan view of a known snap fastener washer.

Ordinarily, in an instance where pawls protrude from a washer, as shown in FIG. 14, the body of each pawl 60 has to be positioned inside a ring 61 which represents the washer and has to extend up therefrom, as otherwise too much raw materials causes a high cost. From the aforesaid viewpoint there was a limit to the length of a pawl and that was just the reason why it was unable to effect a fastening of a thick sheet material by an application of a male or female metal fitting with only the force of the pawl.

According to the present invention, a male or a female metal fitting, together with the respective washer, are caulked so that no space is left therebetween by the force of a short tube provided at the center of the washer and which passes through a cloth to engage into a projecting member of the male metal fitting or an indented wall of the female metal fitting and, at the same time, the fitting and the washer are fastened together at the center thereof and the fringe thereof by pawls which are provided around the fringe of the washer or the fringe of the male or female metal fitting, and which are adapted to penetrate through the cloth and project into a wound and curved edge provided in the male or female metal fitting, or the washer, which are facing each other through the cloth, and are wound up and curved therein. Accordingly a fastening snap according to the present invention applied on a cloth is devoid of separation between a male metal fitting and a washer or between a female metal fitting and a washer, and the fasteners are not only fastened solidly at the applied spot but also, since an unstable or loose fastening due to a thin pawl can be covered by an application of a central short tube as set forth in above, a fastening force from the center and the fringe of the washer permits the use of a thin metal plate for the manufacture of a male or a female metal fitting and a washer and moreover. a fastening snap according to the present invention, no matter how small its diameter, has a force sufficient to make a solid fastening onto sheet material.

I claim:

1. In a snap fastener of the type including a male member having a projecting head and a female member formed with a recess in which the projecting head is releasably engageable, with each member being constituted by a metal fitting, engageable with one surface of a sheet of material, and a metal washer, engageable with the other surface of the sheet, with the metal fitting and metal washer being secured to each other by piercing means extending through the sheet, to clamp the sheet therebetween, the improvement comprising, in combination, the metal washer of each said male and female members being formed with a disc portion having a short tube extending perpendicularly from the center thereof and constituting a sheet piercing means; the metal fitting of each of said male and female members being formed with a central hollow portion defining a recess having a central opening for projection of the tube of the associated washer into said central hollow portion during assembly of the respective member to the sheet; one of the two parts of each of said male and female members being formed with a peripheral portion curved on itself to define an annular groove opening toward the other part of the associated member; the other of the two parts of each of said male and female members being formed with barbs projecting vertically therefrom adjacent its periphery and constituting sheet piercing means engageable in said annular groove during assembly of the respective member to the sheet; whereby, upon assembly of each member to the sheet, the associated tube may be crimped in the associated central hollow section and the associated barbs may be crimped in the associated annular groove, so that the two parts of each male and female member are firmly anchored to each other at both their center portions and their peripheries to clamp the sheet firmly therebetween.

2. In a snap fastener, the improvement claimed in claim 1, in which the metal fitting of said male member has said projecting head and said projecting head is hollow to define said recess having said central opening for projecting of the tube of the male metal washer into the hollow central portion.

3. In a snap fastener, the improvement claimed in claim 1, in which the metal washer of each said male and female members is formed with said peripheral portion curved on itself to define an annular groove opening toward the metal fitting on the associated member; the metal fitting of each of said male and female members being formed with said barbs.

4. In a snap fastener, the improvement claimed in claim 1, in which the metal fitting of each of said male and female members is formed with said peripheral portion curved on itself to define said annular groove opening toward the washer of the associated member; the metal washer of the associated member being formed with said barbs.

5. In a snap fastener, the improvement claimed in claim 1, in which said annular groove formed in one part of each of said male and female members opens in a direction which is oblique to the axis of said one part.

* * * * *